US008552321B2

(12) United States Patent
Low et al.

(10) Patent No.: US 8,552,321 B2
(45) Date of Patent: Oct. 8, 2013

(54) MULTIPLE-POLE SINGLE-THROW DOME SWITCH ASSEMBLIES

(75) Inventors: Wing Kong Low, Sunnyvale, CA (US); Thai Quoc La, San Jose, CA (US)

(73) Assignee: Apple Inc., Cupertino, CA (US)

( * ) Notice: Subject to any disclaimer, the term of this patent is extended or adjusted under 35 U.S.C. 154(b) by 321 days.

(21) Appl. No.: 12/793,193

(22) Filed: Jun. 3, 2010

(65) Prior Publication Data

US 2011/0297524 A1 Dec. 8, 2011

(51) Int. Cl.
*H01H 13/70* (2006.01)

(52) U.S. Cl.
USPC ..... 200/512

(58) Field of Classification Search
USPC ..... 200/512
See application file for complete search history.

(56) References Cited

U.S. PATENT DOCUMENTS

| | | | | |
|---|---|---|---|---|
| RE30,923 | E | 5/1982 | Durkee et al. | |
| 4,476,355 | A | 10/1984 | Mital | |
| 6,303,887 | B1 * | 10/2001 | Ando | 200/512 |
| 6,423,918 | B1 | 7/2002 | King et al. | |
| 6,498,312 | B1 * | 12/2002 | Villain | 200/510 |
| 6,670,562 | B2 * | 12/2003 | Kaneko | 200/1 B |
| 8,212,160 | B2 * | 7/2012 | Tsao | 200/1 B |
| 2003/0160712 | A1 | 8/2003 | Levy | |
| 2006/0159448 | A1 * | 7/2006 | Terashima | 396/542 |
| 2009/0301855 | A1 | 12/2009 | Kang | |
| 2010/0258425 | A1 * | 10/2010 | Takahashi et al. | 200/512 |

* cited by examiner

*Primary Examiner* — Vanessa Girardi
(74) *Attorney, Agent, or Firm* — Brownstein, Hyatt, Farber & Schreck, LLP

(57) ABSTRACT

Multiple-pole single-throw dome switch assemblies for electronic devices and methods for creating the same are provided. For example, a switch assembly may include a deformable dome that may have a conductive inner surface. The switch assembly may also include three conductive pads, at least two of which may be positioned underneath the dome. When the dome is deformed, each one of the three conductive pads may be electrically coupled to the conductive inner surface of the dome. When the dome is not deformed, at least one of the three conductive pads may be electrically isolated from the conductive inner surface of the dome.

24 Claims, 10 Drawing Sheets

MULTIPLE-POLE SINGLE-THROW DOME SWITCH ASSEMBLIES

FIELD OF THE INVENTION

This can relate to switch assemblies for electronic devices and, more particularly, to multiple-pole single-throw dome switch assemblies for electronic devices.

BACKGROUND OF THE DISCLOSURE

Many electronic devices (e.g., media players and cellular telephones) often include one or more input switch assemblies for allowing a user to interact with the device. For example, many electronic devices often include one or more dome switch assemblies that may be physically manipulated by a user to control electrical signal connections of the device. A dome switch may often include a depressible dome-shaped actuator with a conductive inner surface operative to close a circuit when the dome is inverted and the inner surface is moved into contact with a conductive pad located underneath the dome, such as a pad coupled to a circuit board or one or more electronic components of the electronic device. The dome may also be electrically coupled to another conductive pad that is electrically isolated from the pad located underneath the depressible portion of the dome such that, when the dome is inverted, the conductive dome may electrically couple the two conductive pads and close a circuit of the electronic device.

This single-pole single-throw dome switch arrangement, which allows one pair of contacts of a single circuit to either be closed or open, may work well in some circumstances. However, certain electronic devices may use dome switches to control circuits coupled to two or more components that should be isolated from one another. Therefore, devices equipped with single-pole single-throw dome switches may often need to rely on diodes or other additional circuitry in order to isolate the various components controlled by the dome switches.

SUMMARY OF THE DISCLOSURE

Therefore, multiple-pole single-throw dome switch assemblies for electronic devices and methods for creating the same are provided.

According to some embodiments, there is provided a switch assembly for an electronic device that may include a first conductive pad, a second conductive pad, a third conductive pad, and an actuator having an inner conductive surface. The actuator may be deformable from an undeformed state to a deformed state. The inner conductive surface may be electrically coupled to each one of the first, second, and third conductive pads when the actuator is in the deformed state, and the inner conductive surface may be electrically decoupled from at least one of the first, second, and third conductive pads when the actuator is in the undeformed state.

According to some other embodiments, there is provided a multiple-pole single-throw switch assembly that may include three electrical contacts and a depressible dome having a conductive layer. The dome may be configured to electrically couple each one of the three contacts with the conductive layer when the dome is depressed, and electrically isolate at least one of the three contacts from the conductive layer when the dome is not depressed.

According to other embodiments, there is provided electronic device circuitry that may include a first multiple-pole single-throw dome switch assembly, a second multiple-pole single-throw dome switch assembly, a first electronic component, and a second electronic component. The first electronic component may be coupled to a first pole of the first multiple-pole single-throw dome switch assembly and to a first pole of the second-multiple pole single-throw dome switch assembly. The second electronic component may be coupled to a second pole of the first-multiple pole single-throw dome switch assembly and to a second pole of the second-multiple pole single-throw dome switch assembly. In some embodiments, a first port of the first electronic component may be coupled to the first pole of the first multiple-pole single-throw dome switch assembly and to the first pole of the second-multiple pole single-throw dome switch assembly, a first port of the second electronic component may be coupled to the second pole of the first-multiple pole single-throw dome switch assembly, and a second port of the second electronic component may be coupled to the second pole of the second-multiple pole single-throw dome switch assembly.

According to other embodiments, there is provided a method for manufacturing a dome switch assembly that may include providing a deformable actuator having a conductive inner surface. The method may also include positioning a first conductive pad in a first position underneath the inner surface that may be electrically isolated from the inner surface when the actuator is undeformed and that may be electrically coupled to the inner surface when the actuator is deformed. The method may also include positioning a second conductive pad in a second position underneath the inner surface that may be electrically isolated from the first conductive pad and the inner surface when the actuator is undeformed and that may be electrically coupled to the inner surface when the actuator is deformed. The method may also include positioning a third conductive pad in a third position that may be electrically coupled to the inner surface when the actuator is deformed.

According to yet other embodiments, there is provided a method of manufacturing an actuator for a dome switch that may include constructing a deformable dome with a conductive inner surface and forming at least two conductive dimples. Each of the dimples may extend away from a different portion of the inner surface. In some embodiments, at least a portion of the constructing step and at least a portion of the forming step may be performed simultaneously.

Moreover, in some embodiments, at least one of the constructing step and the forming step may include at stamping and/or molding.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which.

DETAILED DESCRIPTION OF THE DISCLOSURE

Multiple-pole single-throw dome switch assemblies for electronic devices and methods for creating the same are provided and described with reference to FIGS. 1-7.

Multiple-pole single-throw dome switch assemblies for electronic devices and methods for creating the same are provided. For example, a switch assembly may include a deformable dome that may have a conductive inner surface. The switch assembly may also include three conductive pads, at least two of which may be positioned underneath the dome. When the dome is deformed, each one of the three conductive pads may be electrically coupled to the conductive inner surface of the dome. When the dome is not deformed, at least one of the three conductive pads may be electrically isolated from the conductive inner surface of the dome.

Figure 1:
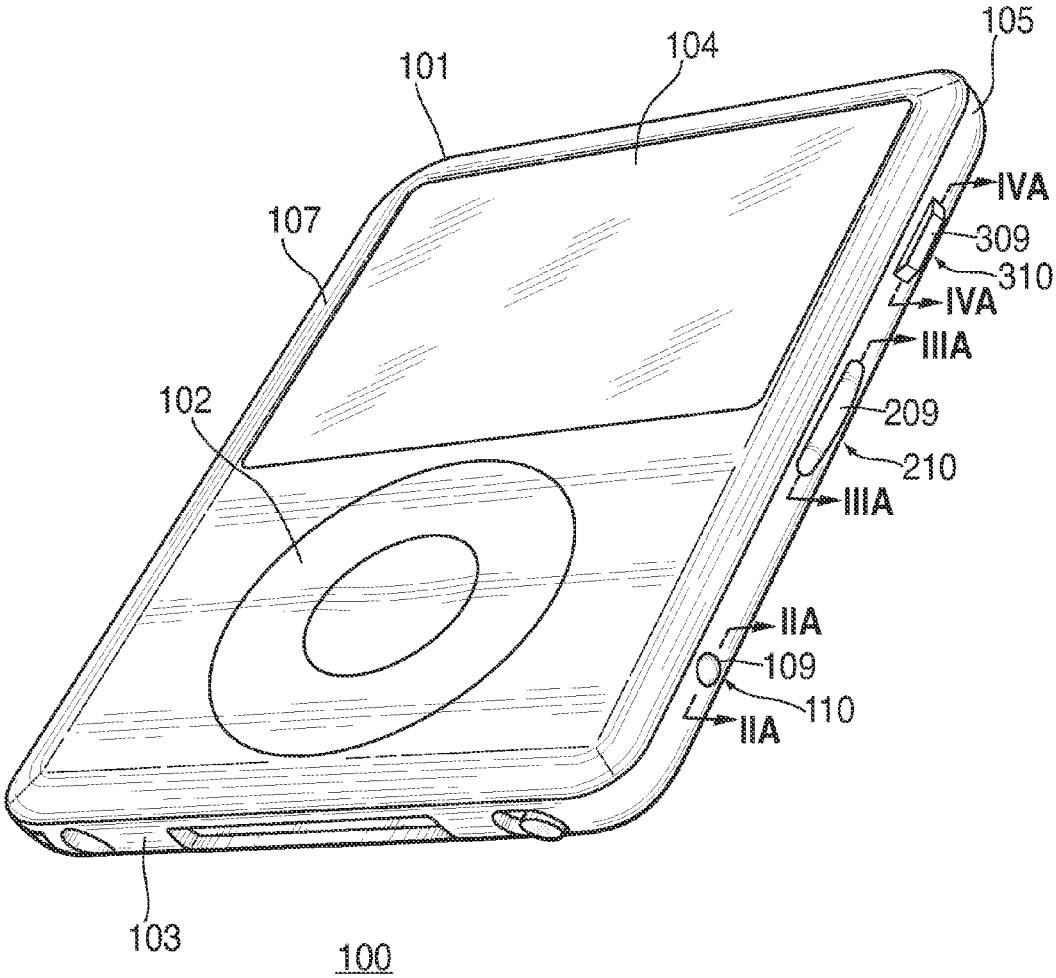
FIG. 1 is a bottom, front, right perspective view of an electronic device including switch assemblies in accordance with some embodiments of the invention.

FIG. 1 is a perspective view of an illustrative electronic device 100 that may include one or more switch assemblies configured in accordance with various embodiments of the invention.

Electronic device 100 can include any suitable electronic device capable of receiving inputs through one or more switch assemblies, such as switch assembly 110. The term "electronic device" can include, but is not limited to, music players, video players, still image players, game players, other media players, music recorders, video recorders, cameras, other media recorders, radios, medical equipment, domestic appliances, transportation vehicle instruments, musical instruments, calculators, cellular telephones, other wireless communication devices, personal digital assistants, remote controls, pagers, computers (e.g., desktops, laptops, tablets, servers, etc.), monitors, televisions, stereo equipment, set up boxes, set-top boxes, boom boxes, modems, routers, keyboards, mice, speakers, printers, and combinations thereof. In some embodiments, electronic device 100 may perform a single function (e.g., a device dedicated to playing music) and, in other embodiments, electronic device 100 may perform multiple functions (e.g., a device that plays music, displays video, stores pictures, and receives and transmits telephone calls).

Electronic device 100 may generally be any portable, mobile, hand-held, or miniature electronic device having at least one switch assembly. Miniature electronic devices may have a form factor that is smaller than that of hand-held personal media devices, such as an iPod™ Shuffle available by Apple Inc. of Cupertino, Calif. Illustrative miniature electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or combinations thereof. Alternatively, electronic device 100 may not be portable at all.

Along with at least one switch assembly 110, electronic device 100 may also include one or more additional electronic components, some of which may be configured to be controlled by signals affected by one or more switch assemblies of device 100. For example, as shown in FIG. 1, device 100 may include one or more input component assemblies 102 that can allow a user to manipulate at least one function of the device, one or more output component assemblies 104 that can provide the user with device generated information, and at least one protective housing 101 that can at least partially enclose switch assembly 110, input component assembly 102, and/or output component assembly 104 of device 100.

Component assemblies 102 and 104 can include any type of component assembly operative to receive and/or transmit digital and/or analog data (e.g., audio data, video data, other types of data, or a combination thereof). Input component assembly 102 may include any suitable input mechanism, such as, for example, sliding switches, buttons, keypads, track balls, joysticks, dials, scroll wheels, touch screen displays, electronics for accepting audio and/or visual information, antennas, infrared ports, or combinations thereof. Output component assembly 104 may include any suitable output component forms, such as, for example, audio speakers, headphones, audio line-outs, visual displays, antennas, infrared ports, rumblers, vibrators, or combinations thereof. It should be noted that one or more input component assemblies 102 and one or more output component assemblies 104 may sometimes be referred to collectively herein as an input/output ("I/O") interface. It should also be noted that an input component assembly 102 and an output component assembly 104 may sometimes be a single I/O component, such as a touch screen that may receive input information through a user's touch of a display screen and that may also provide visual information to a user via that same display screen.

As shown in FIG. 1, for example, housing 101 of device 100 can be hexahedral and may include a bottom wall 103, a top wall (not shown) opposite bottom wall 103, a right side wall 105, a left side wall (not shown) opposite right side wall 105, a front wall 107, and a back wall (not shown) opposite front wall 107. While each of the walls of housing 101 may be substantially flat (see, e.g., front wall 107), the contour of one or more of the walls of housing 101 can be at least partially curved, jagged, or any other suitable shape or combination thereof, in order to contour at least a portion of the surface of device 100 to the hand of a user, for example. It should be noted that housing 101 of device 100 is only exemplary and need not be substantially hexahedral. For example, in certain embodiments, the intersects of certain walls may be beveled, and housing 101 itself may generally be formed in any other suitable shape, including, but not limited to, substantially spherical, ellipsoidal, conoidal, octahedral, or a combination thereof. As shown in FIGS. 1-2D, for example, switch assembly 110 may be provided at an opening 109 through right side wall 105 of electronic device 100. However, it is to be understood that switch assembly 110 and any other switch assembly of device 100 may be provided at any portion of any wall or walls of housing 101 and not just right side wall 105.

Switch assembly 110 may be a dome switch assembly or any other suitable type of switch assembly having an actuator that may deform to close an otherwise open circuit of device 100 or, alternatively, to open an otherwise closed circuit of device 100. For example, as shown in FIGS. 2A-2E, switch assembly 110 may include an actuator 112 having a conductive inner or interior surface 111 and an outer or exterior surface 113 that may extend between an edge or peripheral portion 114. Actuator 112 may be positioned over and/or adjacent to three or more conductive pads 122 of switch assembly 110, each of which may be electrically isolated from one another and coupled to one or more electronic components of device 100.

Figure 2A:
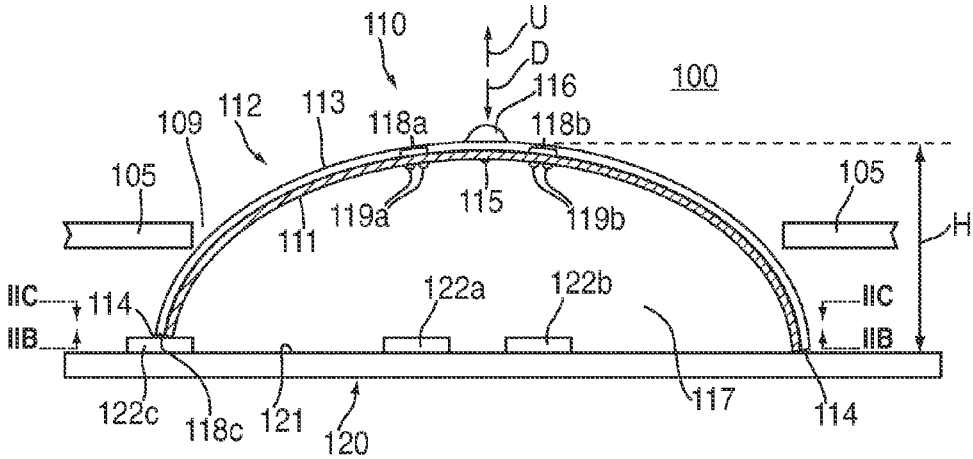
FIG. 2A is a horizontal cross-sectional view of a first switch assembly of FIG. 1, in an undeformed state, taken from line IIA-IIA of FIG. 1, in accordance with some embodiments of the invention.

For example, as shown in FIG. 2A, switch assembly 110 may include at least a first conductive pad 122*a*, a second conductive pad 122*b*, and a third conductive pad 122*c*. In some embodiments, as shown in FIG. 2A, each conductive pad 122 may be coupled to a circuit board 120 or one or more other supportive elements of device 100, which may include leads or other elements (not shown) that can couple each pad 122 to one or more respective electronic components of device 100 (not shown). For example, each pad 122 may be mounted or otherwise coupled to a top surface 121 of circuit board 120. Alternatively, each conductive pad 122 may be coupled directly to one or more respective electronic components of device 100 and not via circuit board 120. Each conductive pad 122 may be made of copper or any other suitable material that may conduct electricity when electrically coupled to actuator 112.

As shown in FIG. 2A, actuator 112 may be shaped to have an original or undeformed state that can define a concavity or otherwise suitably shaped hollow 117 under which at least two pads 122 of assembly 110 may be positioned, such that conductive inner surface 111 of undeformed actuator 112 may be physically and/or electrically decoupled from at least those two underlying pads 122. When a downward force is applied to actuator 112 by a user 1 in the direction of arrow D, as shown in FIG. 2D, for example, at least a portion of actuator 112 may be depressed or otherwise deformed into a deformed state that can electrically couple conductive inner surface 111 to each pad 122 positioned thereunder. Moreover, at least one other pad 122 of assembly 110 may be positioned with respect to actuator 112 such that each one of the three or more pads 122 of switch assembly 110 may be electrically coupled to inner surface 111 at least when actuator 112 is in its deformed state.

Therefore, when in its deformed state, conductive inner surface 111 of actuator 112 can electrically couple conductive pads 122*a*, 122*b*, and 122*c* to one another and close a circuit defined by pads 122*a*, 122*b*, and 122*c*. When the downward force is released by user 1, at least a portion of actuator 112 may be configured to return to its undeformed state (e.g., may reconform upwardly in the direction of arrow U from its deformed state of FIG. 2D to its undeformed state of FIG. 2A), such that conductive inner surface 111 of actuator 112 can be electrically decoupled from at least one pad 122, and such that the circuit defined by pads 122*a*, 122*b*, and 122*c* may be opened. That is, conductive inner surface 111 may return to its undeformed state such that at least one of pads 122 may be separated from surface 111, for example, by an insulating air gap, such that the circuit defined by pads 122*a*, 122*b*, and 122*c* may be said to be "open", and such that no current may flow at typical voltages between surface 111 and at least one of pads 122.

For example, as shown in FIGS. 2A-2D, at least two conductive pads 122, such as first conductive pad 122*a* and second conductive pad 122*b*, may be positioned underneath hollow 117 defined by actuator 112 in its undeformed state. When actuator 112 is in its undeformed state of FIG. 2A, at least those two pads 122*a* and 122*b* may be electrically decoupled from conductive inner surface 111. However, when actuator 112 is depressed or otherwise reconfigured into its deformed state of FIG. 2D, a first portion 118*a* of inner conductive surface 111 may be electrically coupled to first conductive pad 122*a* and a second portion 118*b* of inner conductive surface 111 may be electrically coupled to second conductive pad 122*b*. In some embodiments, third conductive pad 122*c* may be electrically coupled to a third portion 118*c* of conductive inner surface 111 when actuator 112 is in both its undeformed state and its deformed state. Alternatively, third conductive pad 122*c* may be electrically decoupled from third portion 118*c* of conductive inner surface 111 when actuator 112 is in its undeformed state and may be electrically coupled to third portion 118*c* of conductive inner surface 111 when actuator 112 is in its deformed state. Regardless, all three conductive pads 122*a*-*c* may only be simultaneously electrically coupled to respective portions 118*a*-*c* of conductive inner surface 111 when actuator 112 is in its deformed state, such that actuator 112 can electrically couple conductive pads 122*a*, 122*b*, and 122*c* to one another and close a circuit defined by pads 122*a*, 122*b*, and 122*c* that may otherwise be open (e.g., when actuator 112 is in its undeformed state).

Figure 2B:
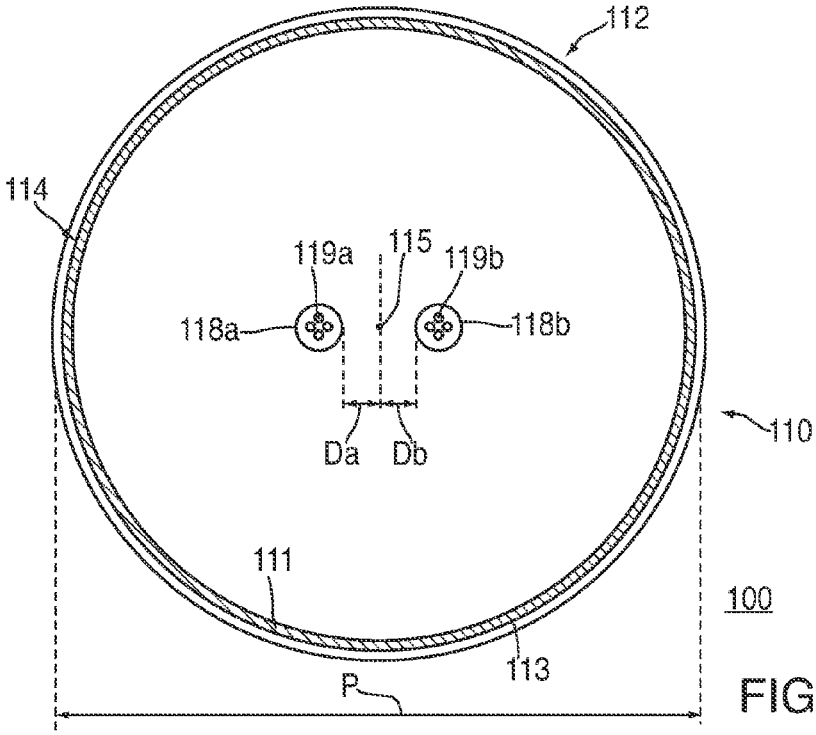
FIG. 2B is a bottom view of a portion of the first switch assembly of FIGS. 1 and 2A, taken from line IIB-IIB of FIG. 2A, in accordance with some embodiments of the invention.
Figure 2C:
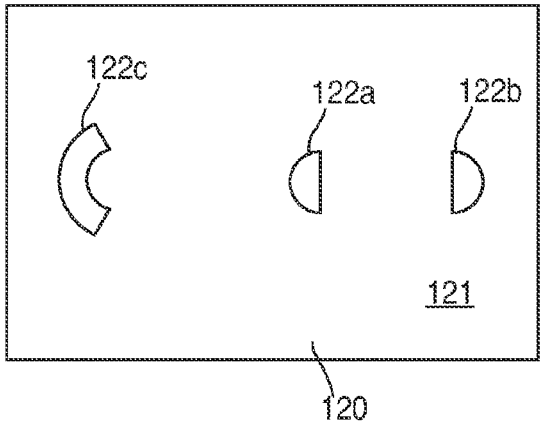
FIG. 2C is a top view of a portion of the first switch assembly of FIGS. 1-2B, taken from line IIC-IIC of FIG. 2B, in accordance with some embodiments of the invention.
Figure 2D:
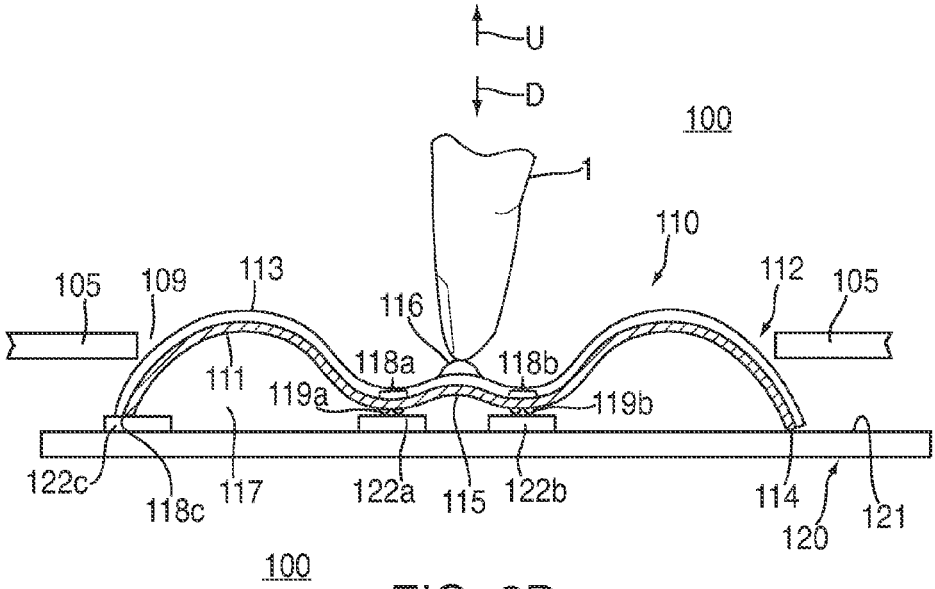
FIG. 2D is a horizontal cross-sectional view, similar to FIG. 2A, of the first switch assembly of FIGS. 1-2C, in a deformed state, in accordance with some embodiments of the invention.
Figure 2E:
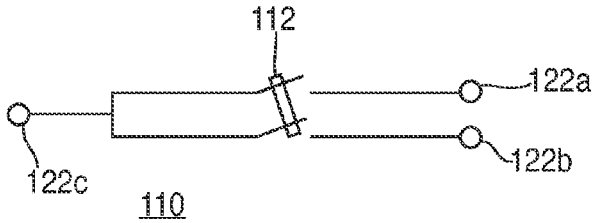
FIG. 2E is a schematic representation of a circuit of the first switch assembly of FIGS. 1-2D, in accordance with some embodiments of the invention.

A schematic representation of the circuit that may be defined by pads 122*a*, 122*b*, and 122*c* of switch assembly 110 is shown in FIG. 2E. Thus, electronic device 100 can be provided with a double-pole single-throw switch assembly 110 that may include a dome or other type of deformable actuator 112 that may be configured to simultaneously open or close the circuit between pads 122*a* and 122*c* and the circuit between pads 122*b* and 122*c*.

Actuator 112 may be coupled to circuit board 120 or any other suitable portion of electronic device 100 using any suitable approach. In some embodiments, an adhesive sheet (not shown) may be placed over external surface 113 of actuator 112 and coupled to circuit board 120 (e.g., top surface 121 of circuit board 120), such that portions of the adhesive sheet may adhere to both actuator 112 and circuit board 120. This may maintain actuator 112 in a functional alignment with conductive pads 122 of switch assembly 110.

Alternatively or additionally, a portion of actuator 112 may be mounted or otherwise coupled to circuit board 120 or any other portion of device 100 in any suitable manner that can maintain actuator 112 in a functional alignment with conductive pads 122 of switch assembly 110 in both its deformed and undeformed states. For example, in some embodiments, third portion 118*c* of inner surface 111 may be positioned at or proximal to peripheral portion 114 and may be physically coupled to third conductive pad 122*c*, such that third pad 122*c* may be electrically coupled to actuator 112 when actuator 112 is in both its deformed state and undeformed state (see, e.g., the left side of FIGS. 2A and 2D).

Alternatively, in some embodiments, a portion of peripheral portion 114 may be physically coupled to circuit board 120 (see, e.g., the right side of FIGS. 2A and 2D). Therefore, in some embodiments, third portion 118*c* of inner surface 111 may or may not be physically coupled to third conductive pad 122*c*. In embodiments where third portion 118*c* is not physically coupled to third conductive pad 122*c*, actuator 112 may be configured such that third portion 118*c* may be electrically coupled to third conductive pad 122*c* only when a user applies a downward force to deform actuator 112 to its deformed state, and such that third portion 118*c* may not be electrically coupled to third conductive pad 122*c* when actuator 112 is in its undeformed state. For example, third portion 118*c* of inner surface 111 may be held above, to the side of, or in any other suitable orientation with respect to third conductive pad 122*c* such that they are not electrically coupled to one another when actuator 112 is in its undeformed state of FIG. 2A.

As shown in FIGS. 2A-2D, for example, first portion 118*a* of inner surface 111 and second portion 118*b* of inner surface 111 may be provided along the surface of inner surface 111 proximate center 115 of inner surface 111. First portion 118*a* may be spaced a first distance Da from center 115 and second portion 118*b* may be spaced a second distance Db from center 115. In some embodiments, distance Da may be equal or substantially equal to distance Db. Moreover, in some embodiments, first portion 118*a* and second portion 118*b* of inner surface 111 may be positioned on opposite sides of center 115, which may maximize the distance between them, and thus the distance that may separate first conductive pad 122*a* and second conductive pad 122*b*. However, it is to be understood that first portion 118*a* and second portion 118*b* of inner surface 111 may be positioned in any orientation with respect to one another and/or center 115 such that they may be electrically coupled with respective conducive pads 122*a* and 122*b* when actuator 112 is deformed.

Moreover, as shown in FIGS. 2A-2D, for example, at least one of first portion 118*a* and second portion 118*b* may include one or more conductive protrusions or dimples 119 extending away from inner surface 111. For example, as shown, first portion 118*a* may include four dimples 119*a* extending from inner surface 111 and second portion 118*b* may include four dimples 119*b* extending from inner surface 111. When actuator 112 is in its deformed state, one or more dimples 119*a* may be electrically coupled to first conductive pad 122*a* and one or more dimples 119*b* may be electrically coupled to second conductive pad 122*b*. Dimples 119 may ensure that conductive inner surface 111 can initiate and maintain an electrically coupled relationship with pads 122*a* and 122*b* when actuator 112 is deformed. Alternatively, at least one of first portion 118*a* and second portion 118*b* may not include any dimples 119. Instead, inner surface 111 may be a generally smooth continuous surface that, when deformed, may initiate and maintain an electrically coupled relationship between first portion 118*a* and first conductive pad 122*a* as well as between second portion 118*b* and second conductive pad 122*b*.

Moreover, as shown in FIGS. 2A-2D, for example, actuator 112 may include one or more nubs 116 extending away from outer surface 113. Nub 116 may be operative to provide an additional element for tactile feedback to a user. Nub 116 may be of any suitable shape including, for example, that of a button or other element that may facilitate receiving the exerted force of a user for deforming actuator 112.

While first portion 118*a* and second portion 118*b* of conductive inner surface 111 may be positioned proximate center 115 of conductive inner surface 111, third portion 118*c* of conductive inner surface 111 may be positioned proximate periphery 114. Alternatively, third portion 118*c* may include a conductive tab (not shown) extending from inner conductive surface 111 that may be electrically coupled to a conductive pad 122 that is not positioned directly under or adjacent actuator 112.

Actuator 112 may be constructed from any suitable deformable material such that actuator 112 may be configured to deform in any suitable manner in response to a user's downward force, including, for example, to buckle or invert, and such that actuator 112 may return to its undeformed state once the user's downward force has been removed. In some embodiments, the deformation of actuator 112 may provide a tactile "click" that may enhance the user's interaction with switch assembly 110. Actuator 112 may be a dome-shaped switch, a snap-acting pressure disc, a snap-acting force disc, a low profile tactile switch, or any other suitable type of switch. Actuator 112 may be an elastically deformable switch. Actuator 112 may be made of any suitable material, including, but not limited to, metal (e.g., stainless steel), plastic, or combinations thereof.

At least a portion of inner surface 111 of actuator 112 may include a conductive portion, such that an electrically conductive path may pass therethrough and between at least three conductive pads 122 of assembly 110 when actuator 112 is in its deformed state. In some embodiments, both inner surface 111 and outer surface 113 of actuator 112 may be at least partially made of a conductive material. In such embodiments, nub 116 may be formed of an insulating material such that user 1 may not impart an electrical signal through actuator 112 and onto one or more of conductive pads 122.

Actuator 112 may be manufactured using any suitable approach. In some embodiments, actuator 112 may be stamped or punched from a sheet of material (e.g., sheet metal). Alternatively, actuator 112 may be manufactured using molding, forging, machining, welding, forming, cutting, or any other manufacturing process or any combinations thereof. In some embodiments, one or more dimples 119 and/or one or more nubs 116 of actuator 112 may be formed during one or more of the same manufacturing steps that may be taken to form at least a portion of the main body and concavity of actuator 112.

Peripheral portion 114 may at least partially define the shape of actuator 112. In some embodiments, actuator 112 may be a spherical dome, such that peripheral portion 114 may be circular, as shown in FIG. 2B, for example. In such embodiments, the diameter or cross-sectional length P of actuator 112 (see, e.g., FIG. 2B) may be greater than, less than, or equal to the height H of hollow 117 of actuator 112 in its undeformed state (see, e.g., FIG. 2A). In other embodiments, the deformable actuator of a switch assembly may be any other suitable shape, such as a spheroidal dome that may have a non-circular ellipsoidal peripheral portion, a frustum that may have a rectangular or non-ellipsoidal peripheral portion, or any other shape that can deform to close a circuit of device 100 defined by three or more conductive pads.

As shown in FIG. 1, electronic device 100 may also include another switch assembly 210, which may be provided at an opening 209 through right side wall 105 of electronic device 100. Switch assembly 210 may be a dome switch assembly or any other suitable type of switch assembly having an actuator that may deform to switch a circuit of device 100, and may be similar to switch assembly 110. For example, as shown in FIGS. 3A-3E, switch assembly 210 may include an actuator 212 having a conductive inner or interior surface 211 and an outer or exterior surface 213 that may extend between an edge or peripheral portion 214. Actuator 212 may be positioned over and/or adjacent to three or more conductive pads 222 of switch assembly 210, each of which may be electrically isolated from one another and coupled to one or more electronic components of device 100.

Figure 3A:
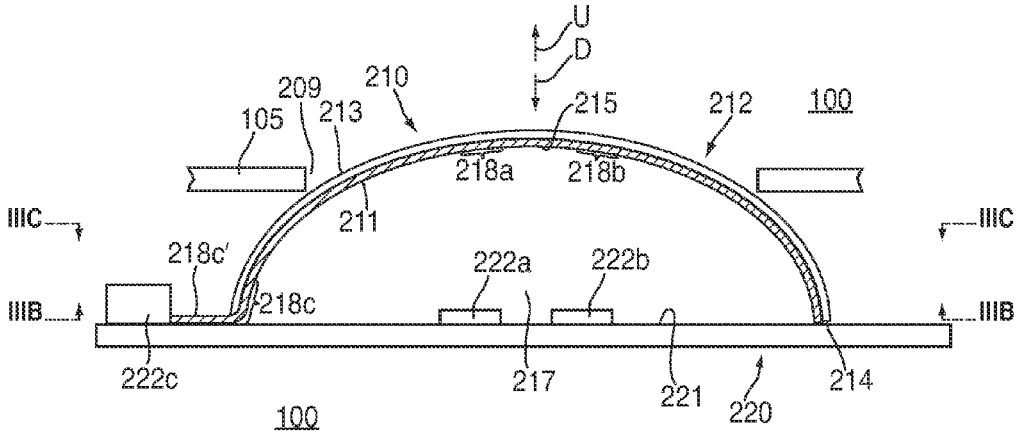
FIG. 3A is a horizontal cross-sectional view of a second switch assembly of FIG. 1, in an undeformed state, taken from line IIIA-IIIA of FIG. 1, in accordance with some embodiments of the invention.

For example, as shown in FIG. 3A, switch assembly 210 may include at least a first conductive pad 222*a*, a second conductive pad 222*b*, and a third conductive pad 222*c*. In some embodiments, as shown in FIG. 3A, each conductive pad 222 may be coupled to an element 220 that may provide support, such as a circuit board that may include leads or other elements (not shown) that can couple each pad 222 to one or more respective electronic components of device 100 (not shown). For example, each pad 222 may be mounted or otherwise coupled to a top surface 221 of element 220.

Figure 3B:
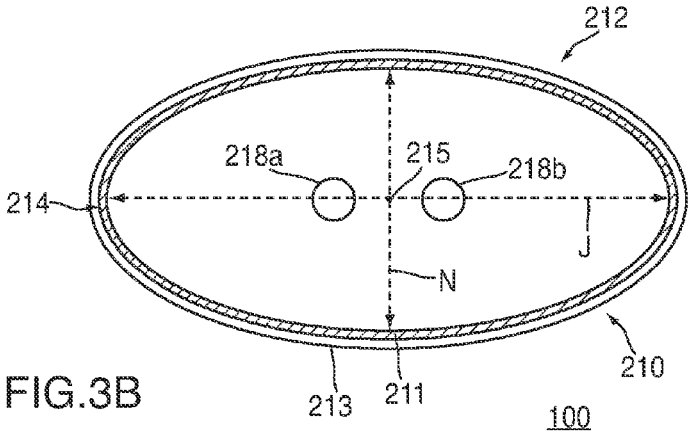
FIG. 3B is a bottom view of a portion of the second switch assembly of FIGS. 1 and 3A, taken from line IIIB-IIIB of FIG. 3A, in accordance with some embodiments of the invention.
Figure 3C:
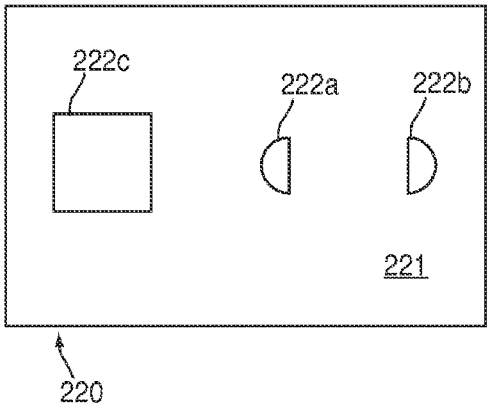
FIG. 3C is a top view of a portion of the second switch assembly of FIGS. 1, 3A, and 3B, taken from line IIIC-IIIC of FIG. 3B, in accordance with some embodiments of the invention.
Figure 3D:
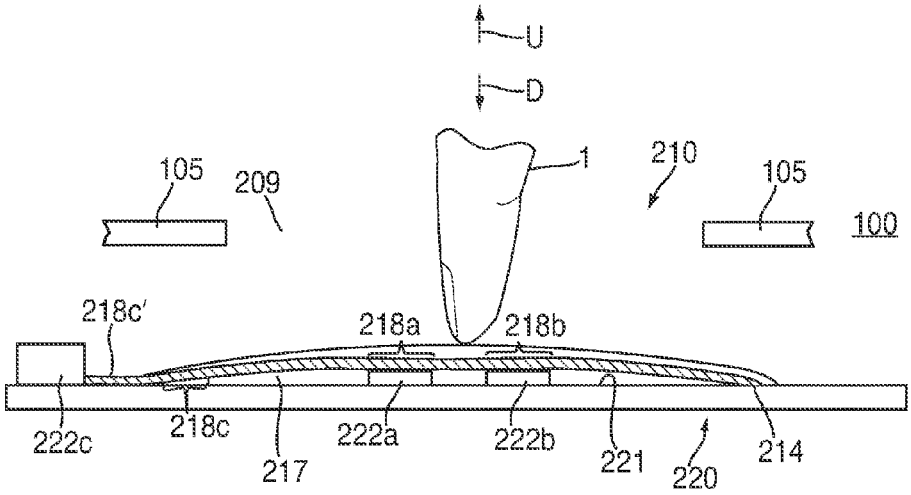
FIG. 3D is a horizontal cross-sectional view, similar to FIG. 3A, of the second switch assembly of FIGS. 1 and 3A-3C, in a deformed state, in accordance with some embodiments of the invention.

As shown in FIG. 3A, actuator 212 may be shaped to have an original or undeformed state that can define a concavity or otherwise suitably shaped hollow 217 under which at least two pads 222 of assembly 210 may be positioned, such that conductive inner surface 211 of undeformed actuator 212 may be physically and/or electrically decoupled from at least those two pads 222. When a downward force is applied to actuator 212 by a user 1 in the direction of arrow D, as shown in FIG. 3D, for example, at least a portion of actuator 212 may be depressed or otherwise deformed into a deformed state that can electrically couple conductive inner surface 211 to each pad 222 positioned thereunder. Moreover, at least one other pad 222 of assembly 210 may be positioned with respect to actuator 212 such that each one of the three or more pads 222 of switch assembly 210 may be electrically coupled to inner surface 211 at least when actuator 212 is in its deformed state.

Therefore, like actuator 112 of switch assembly 110, when in its deformed state, conductive inner surface 211 of actuator 212 can electrically couple conductive pads 222*a*, 222*b*, and 222*c* to one another and close a circuit defined by pads 222*a*, 222*b*, and 222*c*. When the downward force is released by user 1, at least a portion of actuator 212 may be configured to return to its undeformed state (e.g., may reconform upwardly in the direction of arrow U from its deformed state of FIG. 3D to its undeformed state of FIG. 3A), such that conductive inner surface 211 of actuator 212 can be electrically decoupled from at least one pad 222, and such that the circuit defined by pads 222*a*, 222*b*, and 222*c* may be opened. That is, conductive inner surface 211 may return to its undeformed state such that at least one of pads 222 may be separated from surface 211, for example, by an insulating air gap, such that the circuit defined by pads 222*a*, 222*b*, and 222*c* may be said to be "open" and such that no current may flow at typical voltages between surface 211 and at least one of pads 222.

For example, as shown in FIGS. 3A-3D, at least two conductive pads 222, such as first conductive pad 222*a* and second conductive pad 222*b*, may be positioned underneath hollow 217 defined by actuator 212 in its undeformed state. When actuator 212 is in its undeformed state of FIG. 3A, at least those two pads 222*a* and 222*b* may be electrically decoupled from conductive inner surface 211. However, when actuator 212 is depressed or otherwise reconfigured into its deformed state of FIG. 3D, a first portion 218*a* of inner conductive surface 211 may be electrically coupled to first conductive pad 222*a* and a second portion 218*b* of inner conductive surface 211 may be electrically coupled to second conductive pad 222*b*. In some embodiments, third conductive pad 222*c* may be electrically decoupled from third portion 218*c* of conductive inner surface 211 when actuator 212 is in its undeformed state and electrically coupled to third portion 218*c* of conductive inner surface 211 when actuator 212 is in its deformed state.

Alternatively, as shown in FIGS. 3A-3D, third conductive pad 222*c* may be electrically coupled to a third portion 218*c* of conductive inner surface 211 by a conductive tab 218*c*' that may extend out away from concavity 217 of actuator 212 towards third conductive pad 222*c*. Unlike third conductive pad 122*c* of assembly 110, which may be positioned underneath at least a portion of periphery 114 of actuator 112, third conductive pad 222*c* of assembly 210 may be positioned adjacent and outside of periphery 214 of actuator 212. Tab 218*c*' may be constructed from any suitable material including, for example, the same conductive material as at least a portion of inner conductive surface 211. In some embodiments, tab 218*c*' may be constructed as part of the manufacturing process of actuator 212, similarly to dimples 119 and/or nub 116 of actuator 112. For example, tab 218*c*' and the remainder of actuator 212 may be pressed or punched out of the same material simultaneously. Regardless of how third portion 218*c* of actuator 212 may be electrically coupled to third conductive pad 222*c*, all three conductive pads 222*a-c* may only be simultaneously electrically coupled to respective portions 218*a-c* of conductive inner surface 211 when actuator 212 is in its deformed state, such that actuator 212 can electrically couple conductive pads 222*a*, 222*b*, and 222*c* to one another and close a circuit defined by pads 222*a*, 222*b*, and 222*c* that may otherwise be open (e.g., when actuator 212 is in its undeformed state).

Figure 3E:
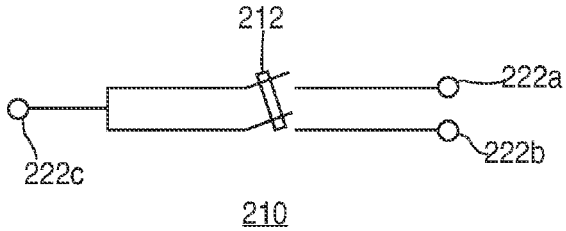
FIG. 3E is a schematic representation of a circuit of the second switch assembly of FIGS. 1 and 3A-3D, in accordance with some embodiments of the invention.

A schematic representation of the circuit that may be defined by pads 222*a*, 222*b*, and 222*c* of switch assembly 210 is shown in FIG. 3E. Thus, electronic device 100 can be provided with a second double-pole single-throw switch assembly 210 that may include a dome or other type of deformable actuator 212 that may be configured to simultaneously open or close the circuit between pads 222*a* and 222*c* and the circuit between pads 222*b* and 222*c*.

Like that of assembly 110, and as shown in FIGS. 3A-3D, for example, first portion 218*a* of inner surface 211 and second portion 218*b* of inner surface 211 may be provided along the surface of inner surface 211 proximate center 215 of inner surface 211. Although not shown, at least one of first portion 218*a* of inner surface 211 and second portion 218*b* of inner surface 211 may include one or more conductive dimples, similar to dimples 119, extending away from inner surface 211. Moreover, although not shown, actuator 212 may include one or more nubs, similar to nub 116, extending away from outer surface 213.

Like actuator 112, actuator 212 may be constructed from any suitable deformable material such that actuator 212 may be configured to deform in any suitable manner in response to a user's downward force, including, for example, to buckle or invert, and such that actuator 212 may return to its undeformed state once the user's downward force has been removed. Actuator 212 may be a dome-shaped switch, a snap-acting pressure disc, a snap-acting force disc, a low profile tactile switch, or any other suitable type of switch. Actuator 212 may be an elastically deformable switch. Actuator 212 may be made of any suitable material, including, but not limited to, metal (e.g., stainless steel), plastic, or combinations thereof. Actuator 212 may be manufactured using any suitable approach. In some embodiments, actuator 212 may be stamped or punched from a sheet of material (e.g., sheet metal). Alternatively, actuator 212 may be manufactured using molding, forging, machining, welding, forming, cutting, or any other manufacturing process or any combinations thereof. In some embodiments, one or more tabs (e.g., tab 218*c*'), dimples, and/or nubs of actuator 212 may be formed during one or more of the same manufacturing steps that may be taken to form at least a portion of the main body and concavity of actuator 212.

Peripheral portion 214 may at least partially define the shape of actuator 212. In some embodiments, actuator 212 may be a spheroidal dome, such that peripheral portion 214 may be an elongated ellipsoid, as shown in FIG. 3B, for example. In such embodiments, a first cross-sectional length of major axis J of peripheral portion 214 of actuator 212 may be greater than a second cross-sectional length of minor axis N of peripheral portion 214 of actuator 212 (see, e.g., FIG. 3B). In such embodiments where peripheral portion 214 of actuator 212 is non-circular, actuator 212 may be positioned with respect to first conductive pad 222*a* and second conductive pad 222*b* such that first portion 218*a* and second portion 218*b* of inner surface 211 may be adjacent one another substantially along either axis of peripheral portion 214. For example, as shown in FIG. 3B, first portion 218*a* and second portion 218*b* of inner surface 211 may be spaced along the surface of inner surface 211 substantially in the same orientation as major axis J. Alternatively, first portion 218*a* and second portion 218*b* of inner surface 211 may be spaced along the surface of inner surface 211 substantially in the same orientation as minor axis N (not shown), or in any other suitable orientation.

In yet other embodiments, for example, as shown in FIGS. 1 and 4A-4E, electronic device 100 may be provided with at least a quadruple-pole single-throw switch assembly 310 that may have a deformable actuator 312. Actuator 312 may be frustum shaped and may have a rectangular or otherwise non-ellipsoidal peripheral portion 314. As shown, switch assembly 310 may be provided at an opening 309 through right side wall 105 of electronic device 100. Switch assembly 310 may be a dome switch assembly or any other suitable type of switch assembly having an actuator that may deform to switch a circuit of device 100, and may be similar to switch assembly 110 and/or switch assembly 210. For example, as shown in FIGS. 4A-4E, switch assembly 310 may include an actuator 312 having a conductive inner or interior surface 311 and an outer or exterior surface 313 that may extend between an edge or peripheral portion 314. Actuator 312 may be positioned over and/or adjacent to five or more conductive pads 322 of switch assembly 310, each of which may be electrically isolated from one another and coupled to one or more electronic components of device 100.

For example, as shown in FIGS. 4A-4E, switch assembly 310 may include at least a first conductive pad 322*a*, a second conductive pad 322*b*, a third conductive pad 322*c*, a fourth conductive pad 322*d*, and a fifth conductive pad 322*e*. In some embodiments, each conductive pad 322 may be coupled to a supportive element 320 of device 100, such as a circuit board that may include leads or other elements (not shown) that can couple each pad 322 to one or more respective electronic components of device 100 (not shown). For example, each pad 322 may be mounted or otherwise coupled to a top surface 321 of element 320.

Figure 4A:
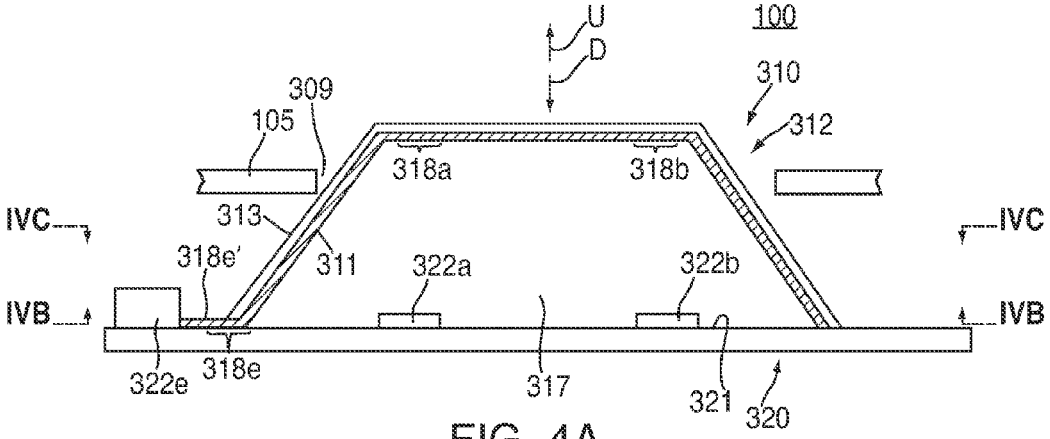
FIG. 4A is a horizontal cross-sectional view of a third switch assembly of FIG. 1, in an undeformed state, taken from line IVA-IVA of FIG. 1, in accordance with some embodiments of the invention.
Figure 4B:
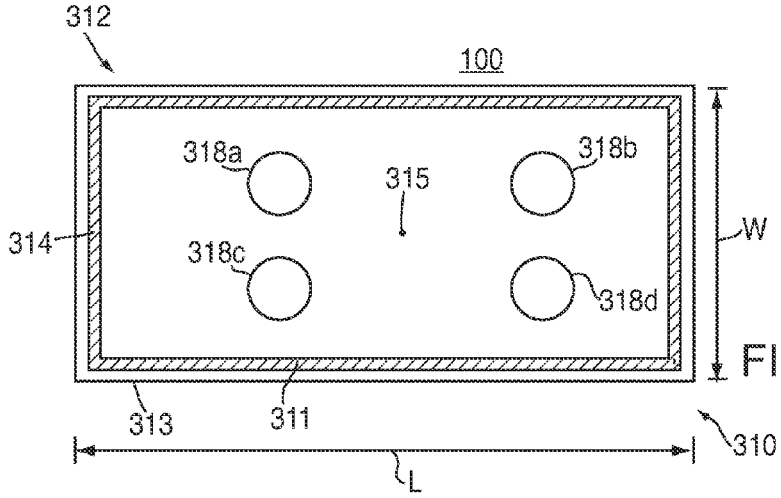
FIG. 4B is a bottom view of a portion of the third switch assembly of FIGS. 1 and 4A, taken from line IVB-IVB of FIG. 4A, in accordance with some embodiments of the invention.
Figure 4C:
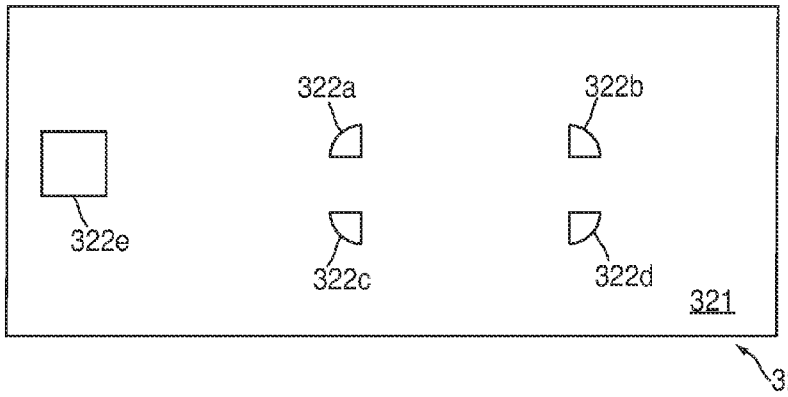
FIG. 4C is a top view of a portion of the third switch assembly of FIGS. 1, 4A, and 4B, taken from line IVC-IVC of FIG. 4B, in accordance with some embodiments of the invention.
Figure 4D:
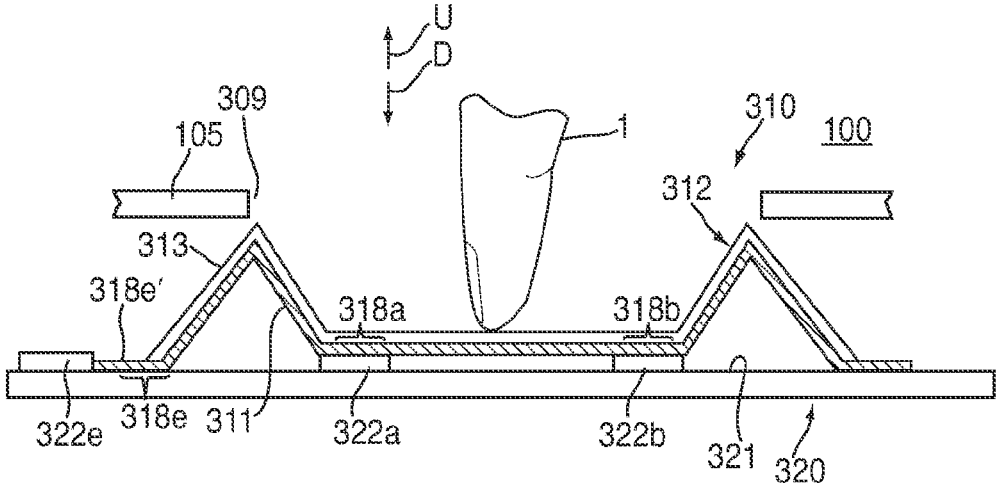
FIG. 4D is a horizontal cross-sectional view, similar to FIG. 4A, of the third switch assembly of FIGS. 1 and 4A-4C, in a deformed state, in accordance with some embodiments of the invention.

As shown in FIG. 4A, actuator 312 may be shaped to have an original or undeformed state that can define a concavity or otherwise suitably shaped hollow 317 under which four or more pads 322 of assembly 210 may be positioned, such that conductive inner surface 311 of undeformed actuator 312 may be physically and/or electrically decoupled from at least those four pads 322. When a downward force is applied to actuator 312 by a user 1 in the direction of arrow D, as shown in FIG. 4D, for example, at least a portion of actuator 312 may be depressed or otherwise deformed into a deformed state that can electrically couple conductive inner surface 311 to each pad 322 positioned thereunder. Moreover, at least one other pad 322 of assembly 310 may be positioned with respect to actuator 312 such that each one of the five or more pads 322 of switch assembly 310 may be electrically coupled to inner surface 311 at least when actuator 312 is in its deformed state.

Therefore, when in its deformed state, conductive inner surface 311 of actuator 312 can electrically couple conductive pads 322*a*, 322*b*, 322*c*, 322*d*, and 322*e* to one another and close a circuit defined by pads 322*a*, 322*b*, 322*c*, 322*d*, and 322*e*. When the downward force is released by user 1, at least a portion of actuator 312 may be configured to return to its undeformed state (e.g., may reconform upwardly in the direction of arrow U from its deformed state of FIG. 4D to its undeformed state of FIG. 4A), such that conductive inner surface 311 of actuator 312 can be electrically decoupled from at least one pad 322, and such that the circuit defined by pads 322*a*, 322*b*, 322*c*, 322*d*, and 322*e* may be opened. That is, conductive inner surface 311 may return to its undeformed state such that at least one of pads 322 may be separated from surface 311, for example, by an insulating air gap, such that the circuit defined by pads 322*a*, 322*b*, 322*c*, 322*d*, and 322*e* may be said to be "open", and such that no current may flow at typical voltages between surface 311 and at least one of pads 322.

For example, as shown in FIGS. 4A-4D, at least four conductive pads 322, such as first conductive pad 322*a*, second conductive pad 322*b*, third conductive pad 322*c*, and fourth conductive pad 322*d*, may be positioned underneath hollow 317 defined by actuator 312 in its undeformed state. When actuator 312 is in its undeformed state of FIG. 4A, at least those four pads 322*a-d* may be electrically decoupled from conductive inner surface 311. However, when actuator 312 is depressed or otherwise reconfigured into its deformed state of FIG. 4D, a first portion 318*a* of inner conductive surface 311 may be electrically coupled to first conductive pad 322*a*, a second portion 318*b* of inner conductive surface 311 may be electrically coupled to second conductive pad 322*b*, a third portion 318*c* of inner conductive surface 311 may be electrically coupled to third conductive pad 322*c*, and a fourth portion 318*d* of inner conductive surface 311 may be electrically coupled to fourth conductive pad 322*d*. In some embodiments, fifth conductive pad 322*e* may be electrically decoupled from fifth portion 318*e* of conductive inner surface 311 when actuator 312 is in its undeformed state and electrically coupled to fifth portion 318*e* of conductive inner surface 311 when actuator 312 is in its deformed state.

Alternatively, as shown in FIGS. 4A-4D, fifth conductive pad 322*e* may be electrically coupled to fifth portion 318*e* of conductive inner surface 311 by a conductive tab 318*e*', similarly to tab 218*c*' of assembly 210. Regardless of how fifth portion 318*e* of actuator 312 may be electrically coupled to fifth conductive pad 322*e*, all five conductive pads 322*a-e* may only be simultaneously electrically coupled to respective portions 318*a-e* of conductive inner surface 311 when actuator 312 is in its deformed state, such that actuator 312 can electrically couple conductive pads 322*a*, 322*b*, 322*c*, 322*d*, and 322*e* to one another and close a circuit defined by pads 322*a*, 322*b*, 322*c*, 322*d*, and 322*e* that may be otherwise open (e.g., when actuator 312 is in its undeformed state).

Figure 4E:
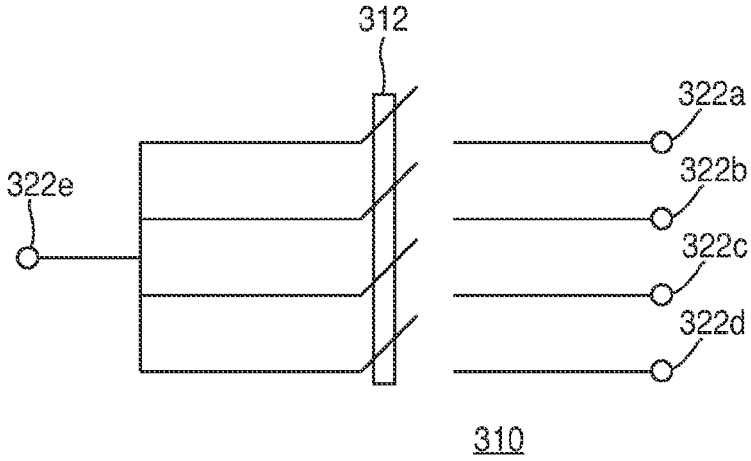
FIG. 4E is a schematic representation of a circuit of the third switch assembly of FIGS. 1 and 4A-4D, in accordance with some embodiments of the invention.

A schematic representation of the circuit that may be defined by pads 322*a*, 322*b*, 322*c*, 322*d*, and 322*e* of switch assembly 310 is shown in FIG. 4E. Thus, electronic device 100 can be provided with a single-throw switch assembly 310 that may have more than just two poles (e.g., a quadruple-pole single-throw switch assembly) and that may include a dome or other type of deformable actuator 312 that may be configured to simultaneously open or close the circuit between pads 322*a* and 322*e*, the circuit between pads 322*b* and 322*e*, the circuit between pads 322*c* and 322*e*, and the circuit between pads 322*d* and 322*e*.

As shown in FIGS. 4A-4D, for example, first portion 318*a* of inner surface 311, second portion 318*b* of inner surface 311, third portion 318*c* of inner surface 311, and fourth portion 318*d* of inner surface 311 may each be provided along the surface of inner surface 311 proximate center 315 of inner surface 311. Although not shown, at least one of first portion 318*a*, second portion 318*b*, third portion 318*c*, and fourth portion 318*d* of inner surface 311 may include one or more conductive dimples, similar to dimples 119, extending away from inner surface 311. Moreover, although not shown, actuator 312 may include one or more nubs, similar to nub 116, extending away from outer surface 313.

Like actuator 112 and/or actuator 212, actuator 312 may be constructed from any suitable deformable material such that actuator 312 may be configured to deform in any suitable manner in response to a user's downward force, including, for example, to buckle or invert, and such that actuator 312 may return to its undeformed state once the user's downward force has been removed. Actuator 312 may be a dome-shaped switch, a snap-acting pressure disc, a snap-acting force disc, a low profile tactile switch, or any other suitable type of switch. Actuator 312 may be an elastically deformable switch. Actuator 312 may be made of any suitable material, including, but not limited to, metal (e.g., stainless steel), plastic, or combinations thereof. Actuator 312 may be manufactured using any suitable approach. In some embodiments, actuator 312 may be stamped or punched from a sheet of material (e.g., sheet metal). Alternatively, actuator 312 may be manufactured using molding, forging, machining, welding, forming, cutting, or any other manufacturing process or any combinations thereof. In some embodiments, one or more tabs (e.g., tab 318*e*'), dimples, and/or nubs of actuator 312 may be formed during one or more of the same manufacturing steps that may be taken to form at least a part of the main body and concavity of actuator 312.

Peripheral portion 314 may at least partially define the shape of actuator 312. In some embodiments, actuator 312 may be a frustum or non-spherical dome, and peripheral portion 314 may be rectangular or otherwise non-ellipsoidal, as shown in FIGS. 4A-4D, for example. In such embodiments, a first cross-sectional length L of rectangular peripheral portion 314 of actuator 312 may be greater than a second cross-sectional width W of rectangular peripheral portion 314 of actuator 312 (see, e.g., FIG. 4B). First portion 318*a* of inner surface 311, second portion 318*b* of inner surface 311, third portion 318*c* of inner surface 311, and fourth portion 318*d* of inner surface 311 may each be equally spaced from center 315 along inner surface 311, as shown in FIG. 4B, for example. Alternatively portions 318*a-d* may be positioned in any suitable way along inner surface 311 such that each portion 318 aligns with its respective conductive pad 322.

As mentioned, certain electronic devices may include a circuitry configuration that may utilize groups of switch assemblies in conjunction with two or more electronic components that may be isolated from one another. Rather than utilizing groups of single-pole single-throw switch assemblies in conjunction with diodes or other additional circuitry in order to isolate the two or more electronic components, a group of multiple-pole single-throw dome switch assemblies, such as assemblies 110, 210, and/or 310 of FIGS. 1-4E may be utilized instead.

Figure 5:
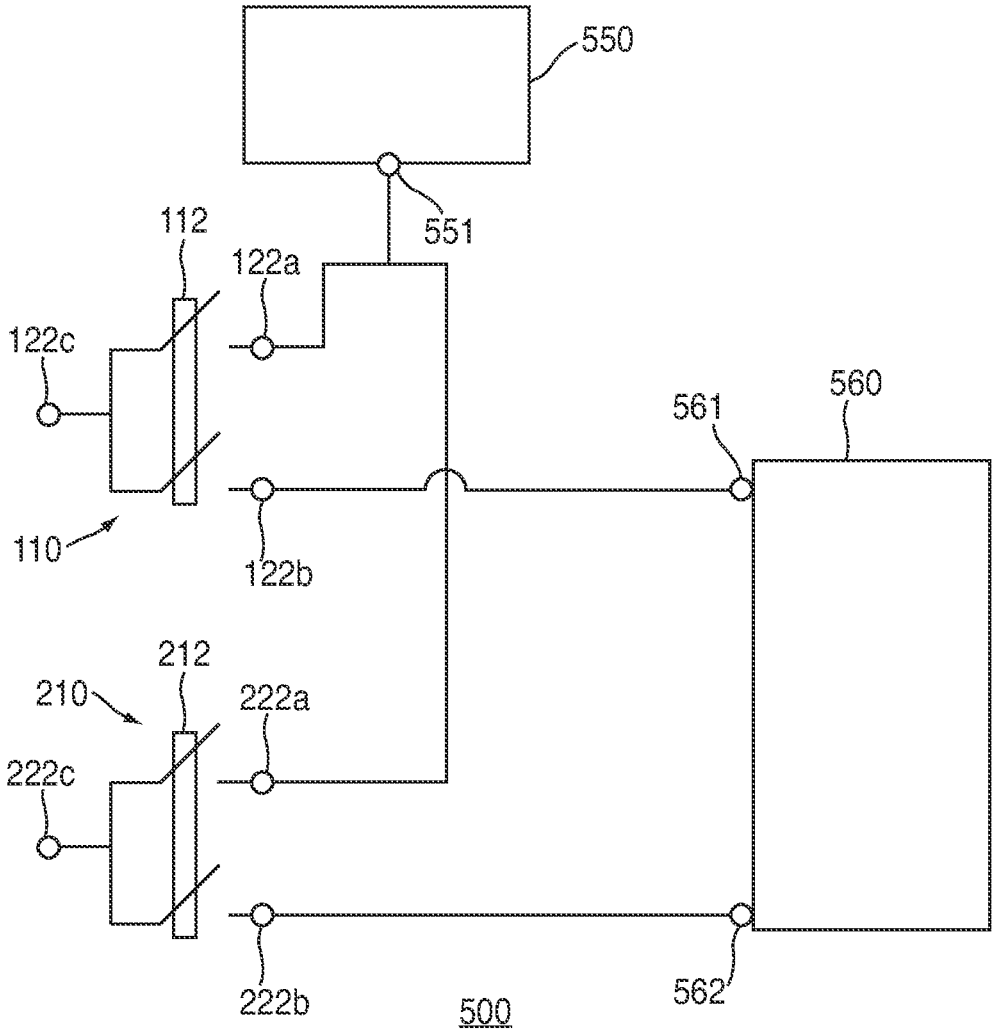
FIG. 5 is a schematic representation of a circuitry configuration incorporating switch assemblies in accordance with some embodiments of the invention.

For example, as shown in FIG. 5, electronic device 100 may include a circuitry configuration 500 that may incorporate a first electronic component 550 and a second electronic component 560 coupled to a group of multiple-pole single-throw dome switch assemblies (i.e., double-pole single throw dome switch assembly 110 of FIGS. 2A-2E and double-pole single throw dome switch assembly 210 of FIGS. 3A-3E). In other embodiments three or more switch assemblies may be included in the group of multiple-pole single-throw dome switches assemblies of circuitry configuration 500. As just one example, first electronic component 550 may be a battery or other type of power providing component and second electronic component 560 may be a micro-controller or other type of processing component.

Such that both first electronic component 550 and second electronic component 560 may each be independently coupled to each switch assembly of circuitry configuration 500, double-pole single-throw dome switch assemblies 110 and 210 may be provided. As shown, a common port 551 of first electronic component 550 may be coupled to both first conductive pad 122*a* of switch assembly 110 and first conductive pad 222*a* of switch assembly 210. In the embodiments where first electronic component 550 may be a battery, power may be able to be provided by common port 551 to each one of switch assemblies 110 and 210, and/or one of switch assemblies 110 and 210 may be closed to provide a control signal to common port 551 (e.g., for instructing first electronic component 550 to power up). Moreover, as shown, individual ports 561 and 562 of second electronic component 560 may be respectively coupled to second conductive pad 122*b* of switch assembly 110 and second conductive pad 222*b* of switch assembly 210. In the embodiments where second electronic component 560 may be a micro-controller, switching events of each switch assembly may be able to be detected by respective ports 561 and 562 of component 560 (e.g., for detecting when a particular switch assembly has been opened or closed).

Therefore, rather than including two or more single-pole single-throw dome switch assemblies, whereby a single conductive pad of a switch assembly might be coupled to both port 551 of first component 550 and port 561 of second component 560, which might thereby require diodes or other additional circuitry in order to isolate the two electronic components from one another, circuitry configuration 500 may incorporate two or more multiple-pole single-throw dome switch assemblies, whereby a first conductive pad of each switch assembly may be coupled to port 551 of first component 550 and whereby a second conductive pad of each switch assembly may be coupled to its own individual port 561/562 of second component 560. Such a configuration may allow each electronic component to be independently coupled to each switch assembly without requiring diodes or other circuitry to help isolate signals between a switching assembly and only one of the two electronic components.

Figure 6:
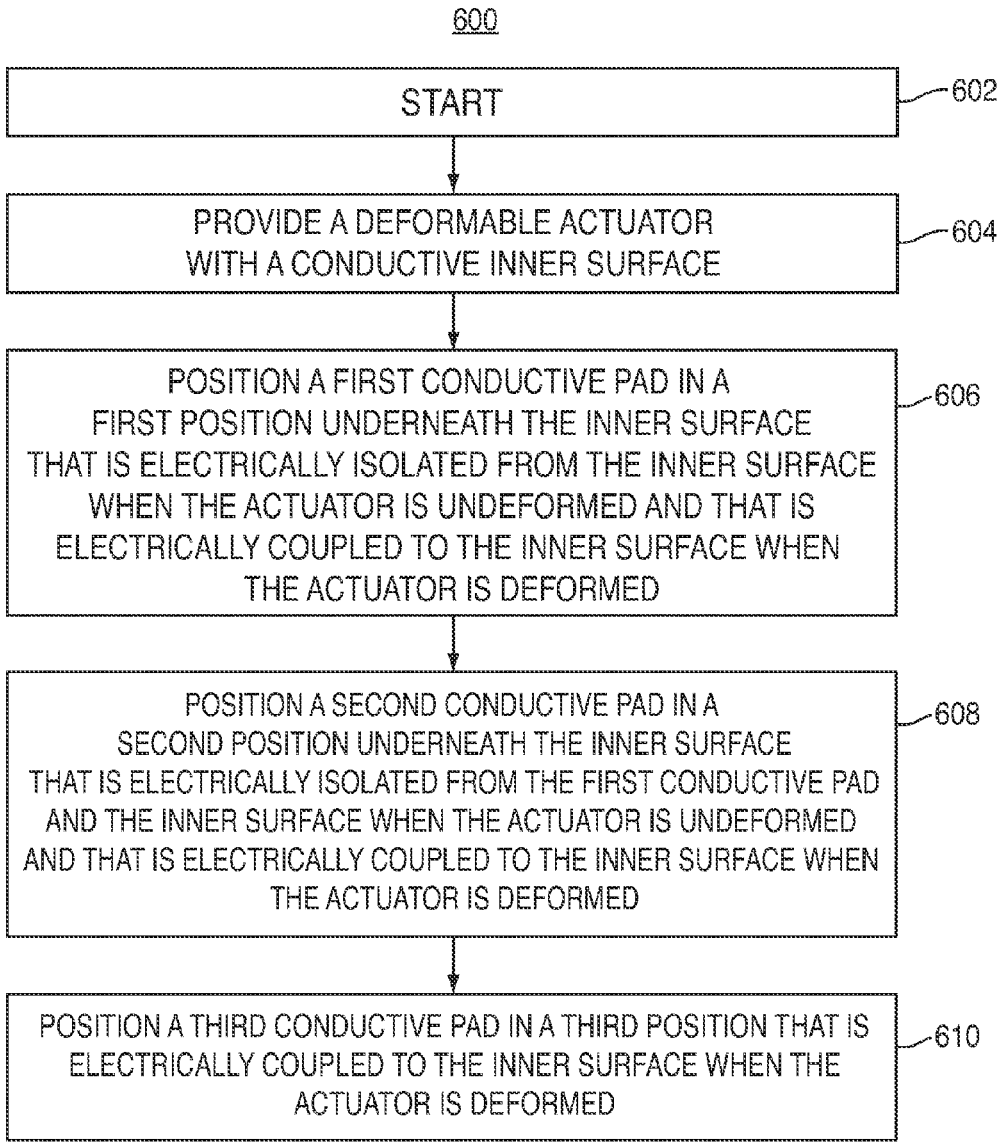
FIG. 6 is a flowchart of an illustrative process for manufacturing a switch assembly in accordance with some embodiments of the invention.

FIG. 6 is a flowchart of an illustrative process 600 for manufacturing a dome switch assembly. Process 600 can begin at step 602. At step 604, a deformable actuator having a conductive inner surface may be provided. The deformable actuator may be similar to any one or more of actuators 112, 212, and/or 312. For example, a sheet of conductive material can be stamped to form a dome-shaped actuator. As another example, a conductive coating can be applied to an isolating material that may be formed as a dome-shaped actuator (e.g., using a molding process). At step 606, a first conductive pad may be positioned in a first position underneath the inner surface. The first position may be electrically isolated from the inner surface when the actuator is undeformed and electrically coupled to the inner surface when the actuator is deformed. At step 608, a second conductive pad may be positioned in a second position underneath the inner surface. The second position may be electrically isolated from the first conductive pad and the inner surface when the actuator is undeformed and electrically coupled to the inner surface when the actuator is deformed. At step 610, a third conductive pad may be positioned in a third position that may be electrically coupled to the inner surface when the actuator is deformed. In some embodiments, step 610 may include physically coupling the third conductive pad to a peripheral portion of the inner surface. Moreover, in some embodiments, one or more of the conductive pads may be positioned on a surface of an electronic device fixture, such as a circuit board.

It is understood that the steps shown in process 600 of FIG. 6 are merely illustrative and that existing steps may be modified or omitted, additional steps may be added, and the order of certain steps may be altered.

Figure 7:
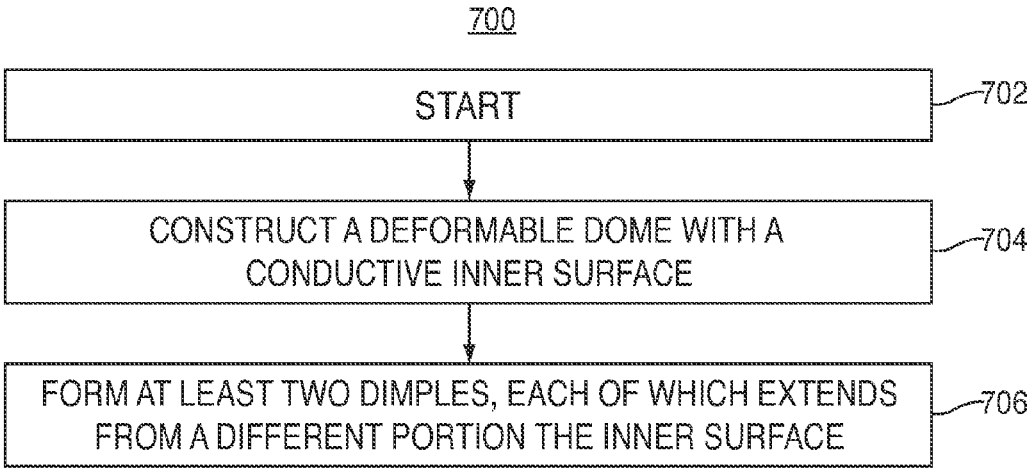
FIG. 7 is a flowchart of an illustrative process for manufacturing a dome of a switch assembly in accordance with some embodiments of the invention.

FIG. 7 is a flowchart of an illustrative process 700 for manufacturing an actuator for a dome switch. Process 700 can begin at step 702. At step 704, a deformable dome with a conductive inner surface may be constructed. At step 706, at least two dimples, each of which may extend from a different portion of the inner surface, may be formed. In some embodiments, at least a portion of the constructing of step 704 and at least a portion of the forming of step 706 may be performed simultaneously. Moreover, in some embodiments, at least one of the constructing of step 704 and the forming of step 706 may include stamping and/or molding.

For example, a sheet of conductive material can be stamped to construct a dome. As another example, a conductive coating can be applied to an isolating material that may be formed as a dome (e.g., using a molding process). The dimples may be formed in any suitable pattern. For example, multiple groups of dimples can be positioned at various distances away from the center of the dome. The dimples can be formed at the same time as the main dome structure (e.g., concurrently with step 704). The dimples may be created during a stamping process or a molding process that may also be used to create at least a portion of the main dome structure. At least a first one of the dimples may be configured to electrically couple with a first contact of an electrical circuit when the dome is deformed, while at least a second one of the dimples may be configured to electrically couple with a second contact of an electrical circuit when the dome is deformed.

It is understood that the steps shown in process 700 of FIG. 7 are merely illustrative and that existing steps may be modified or omitted, additional steps may be added, and the order of certain steps may be altered.

While there have been described multiple-pole single-throw dome switch assemblies for electronic devices and methods for creating the same, it is to be understood that many changes may be made therein without departing from the spirit and scope of the invention. It is also to be understood that various directional and orientational terms such as "up" and "down," "front" and "back," "left" and "right," "top" and "bottom," "above" and "under," and the like are used herein only for convenience, and that no fixed or absolute directional or orientational limitations are intended by the use of these words. For example, the switch assemblies of the invention can have any desired orientation. If reoriented, different directional or orientational terms may need to be used in their description, but that will not alter their fundamental nature as within the scope and spirit of the invention.

Those skilled in the art will appreciate that the invention can be practiced by other than the described embodiments, which are presented for purposes of illustration rather than of limitation.

What is claimed is:

1. A multiple-pole single-throw switch assembly comprising:

three electrical contacts; and a deformable dome comprising an outer layer and a uniform inner conductive layer configured to:

electrically couple each one of the three contacts with the conductive layer only when the dome is deformed; and electrically isolate at least two of the three contacts from the conductive layer when the dome is not deformed.

2. The multiple-pole single-throw switch assembly of claim 1, wherein the dome is further configured to electrically couple a first one of the three contacts with the conductive layer when the dome is deformed and when the dome is not deformed.

3. The multiple-pole single-throw switch assembly of claim 2, wherein the dome is further configured to electrically isolate both a second one of the three contacts and a third one of the three contacts from the conductive layer when the dome is not deformed.

4. The multiple-pole single-throw switch assembly of claim 3, wherein the dome is further configured to electrically couple both the second one of the three contacts and the third one of the three contacts to the conductive layer when the dome is deformed.

5. A switch assembly for an electronic device comprising:

a first conductive pad;

a second conductive pad;

a third conductive pad; and an actuator comprising an inner conductive dome surface, wherein:

the actuator is deformable from an undeformed state to a deformed state;

the inner conductive dome surface is electrically coupled to each one of the first, second, and third conductive pads when the actuator is in the deformed state;

the inner conductive dome surface is electrically decoupled from at least one of the first, second, and third conductive pads when the actuator is in the undeformed state;

a first portion of the inner conductive dome surface comprising a first group of at least two dimples extending away from a first position of the inner conductive dome surface is electrically coupled to the first conductive pad only when the actuator is in the deformed state;

a second portion of the inner conductive dome surface comprising a second group of at least two dimples extending away from a second position of the inner conductive dome surface is electrically coupled to the second conductive pad only when the actuator is in the deformed state;

the first portion of the inner conductive dome surface defines a first portion of a concavity when the actuator is in the undeformed state; and the second portion of the inner conductive dome surface defines a second portion of the concavity when the actuator is in the undeformed state.

6. The switch assembly of claim 5, wherein the first and second positions are proximate to the center of the interior surface of the dome.

7. The switch assembly of claim 5, wherein the first position and the second position are spaced equally apart from the center of the interior surface of the dome.

8. The switch assembly of claim 5, wherein:

a third portion of the inner conductive surface is electrically coupled to the third conductive pad when the actuator is in the deformed state; and the third portion of the inner conductive surface is provided at a peripheral portion of the dome.

9. The switch assembly of claim 5, wherein:

a third portion of the inner conductive surface is electrically coupled to the third conductive pad when the actuator is in the deformed state; and the third portion of the inner conductive surface comprises a conductive tab extending away from the dome.

10. The switch assembly of claim 5, wherein:

the electronic device comprises a circuit board;

the first, second, and third conductive pads are coupled to the circuit board; and at least a portion of the actuator is coupled to the circuit board.

11. The switch assembly of claim 5, wherein:

the electronic device comprises a first electronic component and a second electronic component;

the first conductive pad is electrically coupled to the first electronic component; and the second conductive pad is electrically coupled to the second electronic component.

12. The switch assembly of claim 5, wherein the concavity defines a hollow under which the first conductive pad and the second conductive pad are positioned when the actuator is in the undeformed state.

13. The switch assembly of claim 5, wherein:

the concavity extends between a periphery of the actuator; and at least a portion of the periphery is electrically coupled to the third conductive pad when the actuator is in the undeformed state.

14. The switch assembly of claim 5, wherein at least a portion of the concavity is inverted when the actuator is in the deformed state.

15. The switch assembly of claim 5, wherein:

a third portion of the inner conductive surface is electrically coupled to the third conductive pad when the actuator is in the deformed state;

when the actuator is in the undeformed state, at least one of the first portion and the second portion is in a first plane;

when the actuator is in the undeformed state, the third portion is in a second plane; and the first plane is not parallel to the second plane.

16. The switch assembly of claim 5, wherein:

a third portion of the inner conductive surface is electrically coupled to the third conductive pad when the actuator is in the deformed state.

17. The switch assembly of claim 16, wherein the third portion of the inner conductive surface is also electrically coupled to the third conductive pad when the actuator is in the undeformed state.

18. The switch assembly of claim 16 further comprising at least a fourth contact pad, wherein at least a fourth portion of the inner conductive surface is respectively electrically coupled to the at least a fourth contact pad when the actuator is in the deformed state.

19. Electronic device circuitry comprising: a first multiple-pole single-throw dome switch assembly, comprising:

a first, second, and third conductive pads; and an actuator deformable from an undeformed state to a deformed state comprising an inner conductive dome surface, wherein:

the inner conductive dome surface is electrically coupled to each one of the first, second, and third conductive pads when the actuator is in the deformed state and electrically decoupled from at least one of the first, second, and third conductive pads when the actuator is in the undeformed state;

a first portion of the inner conductive dome surface comprising a first group of at least two dimples extending away from a first position of the inner conductive dome surface is electrically coupled to the first conductive pad only when the actuator is in the deformed state; and a second portion of the inner conductive dome surface comprising a second group of at least two dimples extending away from a second position of the inner conductive dome surface is electrically coupled to the second conductive pad only when the actuator is in the deformed state;

a second multiple-pole single-throw dome switch assembly;

a first electronic component coupled to a first pole of the first multiple-pole single-throw dome switch assembly and to a first pole of the second multiple-pole single-throw dome switch assembly; and a second electronic component coupled to a second pole of the first multiple-pole single-throw dome switch assembly and to a second pole of the second multiple-pole single-throw dome switch assembly.

20. The electronic device circuitry of claim 19, wherein:

a first port of the first electronic component is coupled to the first pole of the first multiple-pole single-throw dome switch assembly and to the first pole of the second multiple-pole single-throw dome switch assembly;

a first port of the second electronic component is coupled to the second pole of the first multiple-pole single-throw dome switch assembly; and a second port of the second electronic component is coupled to the second pole of the second multiple-pole single-throw dome switch assembly.

21. The electronic device circuitry of claim 20, wherein:

the first electronic component is a power providing component; and the second electronic component is a processing component.

22. A switch assembly for an electronic device comprising:

a first conductive pad;

a second conductive pad;

a third conductive pad; and an actuator comprising an inner conductive dome surface, wherein:

the actuator is deformable from an undeformed state to a deformed state;

the inner conductive dome surface is electrically coupled to each one of the first, second, and third conductive pads when the actuator is in the deformed state;

the inner conductive dome surface is electrically decoupled from at least one of the first, second, and third conductive pads when the actuator is in the undeformed state;

a first portion of the inner conductive dome surface is electrically coupled to the first conductive pad only when the actuator is in the deformed state;

a second portion of the inner conductive dome surface is electrically coupled to the second conductive pad only when the actuator is in the deformed state;

a third portion of the inner conductive dome surface is electrically coupled to the third conductive pad when the actuator is in the deformed state;

the first portion of the inner conductive dome surface is provided at a first position along the interior surface of the dome;

the second portion of the inner conductive dome surface is provided at a second position along the interior surface of the dome;

the first portion comprises a first group of at least two dimples; each one of the dimples of the first group extends away from the interior surface of the dome;

at least one of the dimples of the first group electrically contacts the first conductive pad when the actuator is in the deformed state:

the second portion comprises a second group of at least two dimples; each one of the dimples of the second .group extends away from the interior surface of the dome; and at least one of the dimples of the second group electrically contacts the second conductive pad when the actuator is in the deformed state.

23. A method for manufacturing a dome switch assembly comprising:

providing a deformable actuator comprising a conductive inner dome surface;

positioning a first conductive pad in a first position underneath the inner dome surface that is electrically isolated from the inner dome surface when the actuator is undeformed and that is electrically coupled to at least one of a first group of at least two dimples extending away from a first portion of the inner dome surface when the actuator is deformed;

positioning a second conductive pad in a second position underneath the inner dome surface that is electrically isolated from the first conductive pad and the inner dome surface when the actuator is undeformed and that is electrically coupled to at least one of a second group of at least two dimples extending away from a second portion of the inner dome surface when the actuator is deformed; and positioning a third conductive pad in a third position that is electrically coupled to the inner dome surface when the actuator is deformed, wherein:

the first portion of the inner dome surface is deformed when the actuator is deformed;

the first portion of the inner dome surface is undeformed when the actuator is undeformed;

the second portion of the inner dome surface is deformed when the actuator is deformed; and the second portion of the inner dome surface is undeformed when the actuator is undeformed.

24. The method of claim 23, wherein the positioning the third conductive pad comprises physically coupling the third conductive pad to a peripheral portion of the inner surface.

* * * * *